United States Patent [19]

McCadden

[11] 4,398,656

[45] Aug. 16, 1983

[54] DISPENSING APPARATUS FOR TISSUE ROLLS

[76] Inventor: Walter E. McCadden, 3439 Terrace La., Golden Valley, Minn. 55422

[21] Appl. No.: 334,324

[22] Filed: Dec. 24, 1981

[51] Int. Cl.[3] ..... B26D 1/02

[52] U.S. Cl. ..... 225/47; 225/52; 225/53; 225/54

[58] Field of Search ..... 225/47, 51, 52-54, 225/80, 84, 85, 88; 242/55.2, 55.53, 56 R

[56] References Cited

U.S. PATENT DOCUMENTS

| | | | |
|---|---|---|---|
| 1,816,384 | 7/1931 | Marcalus | 225/52 |
| 2,639,099 | 5/1953 | Gough, Jr. | 225/47 X |
| 3,040,943 | 6/1962 | Bump | 225/52 |

*Primary Examiner*—Frank T. Yost
*Attorney, Agent, or Firm*—Dorsey & Whitney

[57] ABSTRACT

A dispensing apparatus for tissue rolls has a body member with a base portion, and a cover which is movable between a closed operating position and an open loading position. The base portion has sidewalls with bearing portions for a cylindrical tissue roll support and a front wall with an opening through which the free end of a tissue roll can be grasped by a finger of the user, pulled out of the opening and severed by engagement with a cutting edge extending across the opening. A lower guide plate member has an outer edge pivotally supported on the base portion for swinging movement around an axis parallel and close to the cutting edge inwardly above the roll support to rest on the tissue roll and support the outermost layer of tissue from the roll toward the cutting edge. A resiliently movable upper guide member is supported on the cover and extends forwardly toward the cutting edge in light frictional engagement with the upper surface of the tissue layer supported on the lower guide plate, when the cover is closed.

17 Claims, 8 Drawing Figures

DISPENSING APPARATUS FOR TISSUE ROLLS

BACKGROUND OF THE INVENTION

The invention relates to apparatus for supporting rolls of tissue paper or other tearable material and more particularly to such apparatus designed for manual withdrawal and separation of one or more sheets or pieces of desired length from a roll of such tissue.

Many devices have been proposed for the dispensing of sheets from a roll of tissue material. In the case of toilet paper, it has been customary to provide merely a cylindrical supporting roller on which a tissue roll of the type having a cylindrical axial central support opening can be mounted, and from which individual sheets can be torn at perforated lines and removed for use.

Dispensing devices have also been provided for wider rolls of paper material, such as paper towels. Many devices of these types are designed for fixed connection to a wall or other support and cannot readily be moved from place to place, if the particular tissue is needed for some other purpose at a location remote from that at which the roll is ordinarily used.

Portable boxes of individual tissues are also well known, and such tissues may be used as facial tissues or as cleaning tissues for eyeglasses. Boxes of such individual tissues are ordinarily more expensive than standard rolls of tissue, such as even the finer grades of toilet paper or paper towels which have cross perforations to facilitate the separation of individual sheets of predetermined length. The use of such standard rolls for a variety of other uses at different locations, however, is handicapped or discouraged by the lack of well-designed dispensers which are appealing in general appearance and efficient in loading and operation and from which portions of different lengths could easily be torn off without limitation to any fixed spacing between preperforated tear lines of a supply roll.

SUMMARY OF THE INVENTION

The present invention accordingly provides an improved dispensing apparatus for tissue rolls of the type having a cylindrical axial central support opening. The improved apparatus includes a body member having axially-spaced tissue roll bearing portions, a cutting edge parallel to the axis of the bearing portions and spaced therefrom, a cylindrical roll support for insertion in a suitable tissue roll and for removably supporting such tissue roll in the bearing portions of the body member, in combination with a lower tissue guide plate having an outer edge pivotally supported on the body member for swinging movement around an axis parallel to and spaced close to the cutting edge. Such guide plate has an inner edge above and parallel to the roll support, and an intermediate plate portion extending between the pivotally-supported outer edge and across the tissue to be withdrawn tangentially from a tissue roll mounted on the roll support. The inner edge of such guide plate is adapted to rest on top of the tissue roll beneath the uppermost layer of tissue to be withdrawn therefrom, and such guide plate thereby supports such layer for movement from the top of the roll to the cutting edge. The improved apparatus further provides a resiliently-movable upper guide member extending in light frictional engagement along the upper surface of a tissue layer supported on the lower guide plate between the tissue roll and cutting edge. Such upper guide thus prevents unintended rewinding and withdrawal of the free end of the outermost tissue layer, after an end portion thereof has been severed at the cutting edge.

In a preferred form of the invention, the body member includes an upwardly open base portion with front, rear and sidewalls and a top opening, and a cover portion relatively movable between an operating position covering the top opening and an open loading position for loading a tissue roll downwardly through the top opening. The bearing portions for the tissue roll support are mounted on the base portion sidewalls, the front wall of the base portion has a transverse feed opening through which the tissue from the outermost roll layer can extend across the cutting edge, and the base portion has guide plate bearing supports for the pivotally-supported outer edge of the lower tissue guide plate, which are positioned for convenient upward pivotal swinging movement of the lower guide plate and its inner edge, when the cover portion is in open position, thereby facilitating insertion of a tissue roll, swinging of the guide plate inner edge down to the top of the roll, and initial threading of the outermost end of the tissue across the top of the guide plate and out through the front wall opening.

In this preferred form of the invention the upper guide or hold-down member is supported on the cover member for automatic engagement with the tissue on the lower guide plate, when the cover is moved to operating position and for automatic removal when the cover moves to loading position. More specifically, the preferred upper guide and hold-down member has a fixed end secured to the cover member at a location close to the plane of the rear base portion wall, and a vertically-movable end extending downwardly and forwardly above the lower guide plate at a vertical angle providing resilient frictional engagement of said hold-down with the tissue on the lower guide plate throughout gradual downward swinging movement of the guide plate as the removal of tissue decreases the diameter of the tissue roll.

The cover portion is preferably constructed with front, rear and sidewalls depending from the top wall of the cover and matching and mating with the front, rear and sidewalls of the base portion, with a separation line between the base and cover portions extending along the top of the tissue opening, so that the desired cutting edge can be formed as an integral part of the cover portion with downwardly pointing teeth extending across that portion of the front wall of the cover portion which defines the upper edge of the tissue withdrawal opening.

A smooth inner wall inclined upwardly and rearwardly from the cutting edge, in combination with open areas in the lower guide and upper hold-down members, provides for insertion of a user's finger through the front opening to press the tissue against the inner wall and slide it down through the opening.

Other features contributing to the efficient operation of such a dispensing apparatus and to its economical production from molded plastic material will be apparent from the following further description.

BRIEF DESCRIPTION OF THE DRAWINGS

In the drawings which form a part of this application, and in which like reference characters indicate like parts.

DESCRIPTION OF THE PREFERRED EMBODIMENTS

Figure 2:
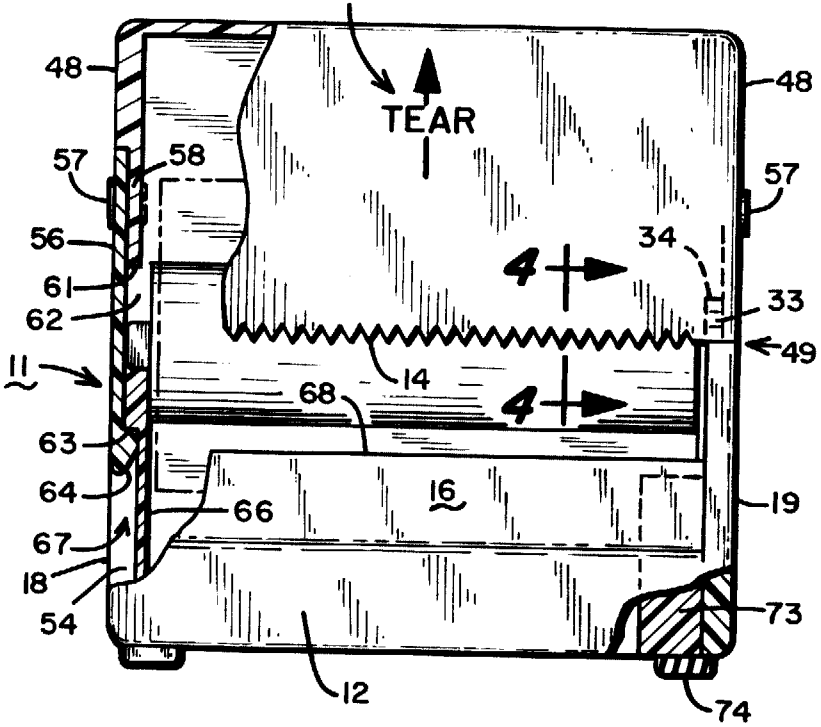
FIG. 2 is a front view of the dispenser of FIG. 1 with portions at the left of FIG. 2 broken away and shown in section along the line 2—2 of FIG. 1, and with other portions at the right of FIG. 2 broken away or shown in dotted outline for convenient understanding.
Figure 1:
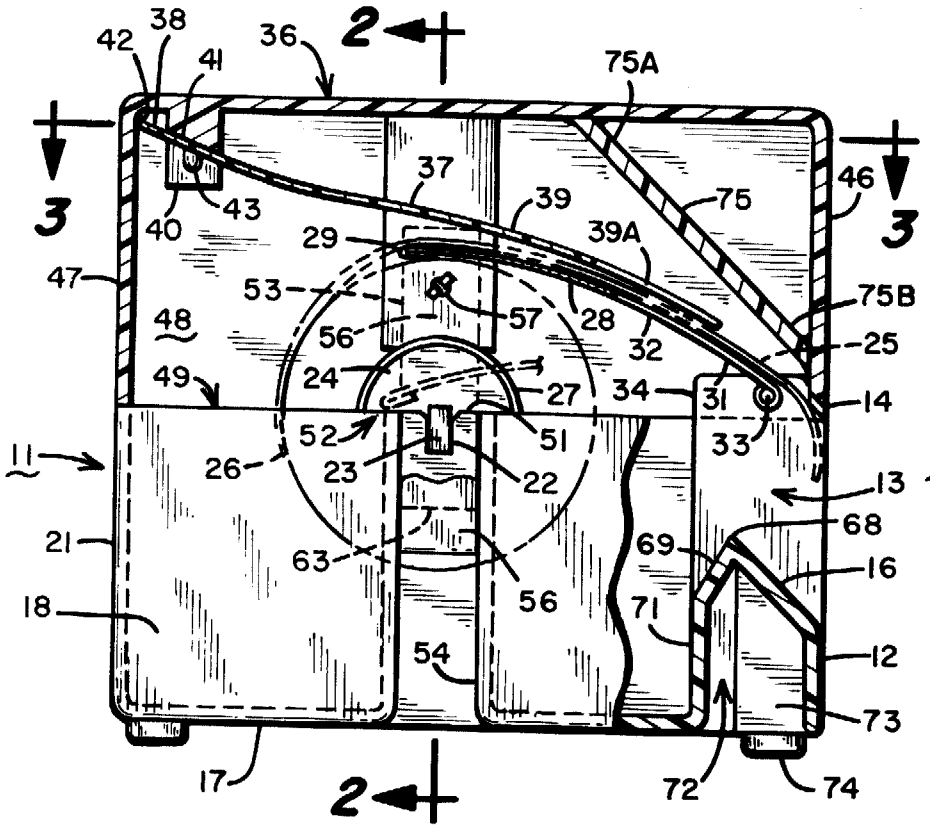
FIG. 1 is a side elevation of a portable tissue dispenser according to the present invention with some portions broken away, some portions shown in section and other portions shown in phantom outline.
Figure 3:
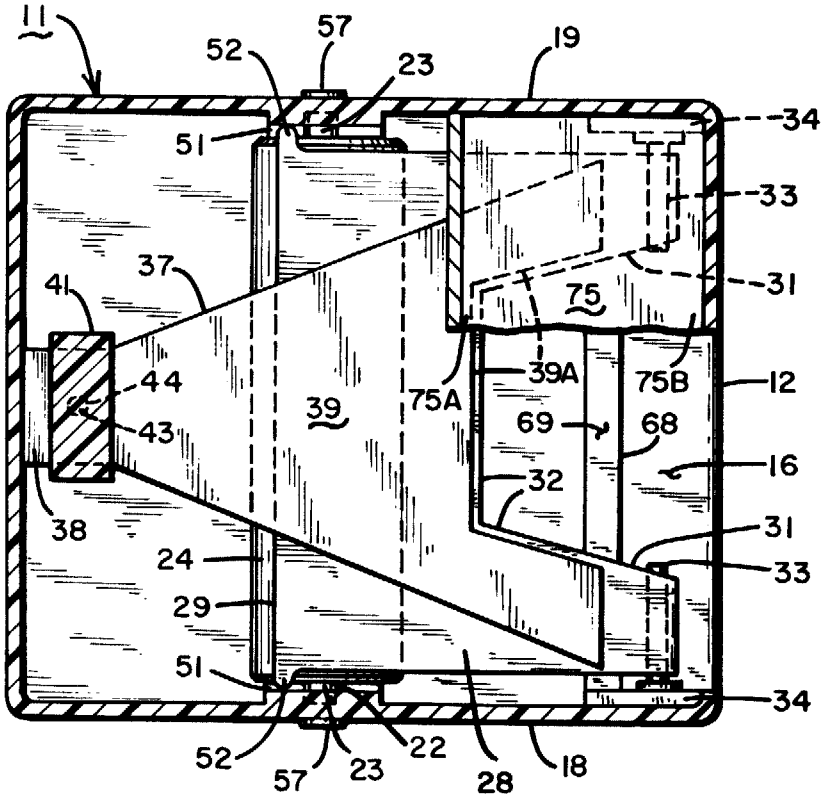
FIG. 3 is a top view of the dispenser of FIG. 1, with the top cover wall portion broken away essentially on the line 3—3 of FIG. 1 and with part of an inner cover wall broken away to show details of the lower guide plate and upper hold-down.

One embodiment of a portable dispensing apparatus according to the present invention has a body portion indicated generally at 11 in FIGS. 1, 2 and 3. The body portion includes a front wall 12 with a laterally and vertically extending opening 13 for withdrawal of tissue from the device. The vertical height of opening 13 is sufficiently great for convenient insertion of the fingers of the user to grasp and withdraw the free end of the tissue from the dispenser.

The dispenser front wall has a cutting edge 14 extending across the top of opening 13. The end piece from the tissue roll within the dispenser can thus be pulled out until a desired length (or a line of cross perforation, if a tissue of the type having such perforations is being utilized) is approximately in line with the cutting edge. The free end can then be pulled upwardly, as suggested by a suitable legend or arrow 15 on the front wall of the dispenser, to sever the free end conveniently from the rest on the strip.

At the lower edge of opening 13, the body member is provided with an upwardly and rearwardly extending ramp 16, which tends to deflect the free end of the tissue strip outwardly through opening 13, if a portion of the strip overruns the cutting edge or is pulled partially out of the dispenser without being severed.

The body member also includes a bottom wall 17, left and right sidewalls 18 and 19, and a rear wall 21. The sidewalls are further provided with supporting notches 22 in the upper edge of bearing plates or a thickened wall extension 51 at the inside of each sidewall. The bearing notches 22 are open at the top for downward insertion of the non-circular supporting end stubs 23 of a cylindrical support 24 for the tissue roll. Thus support 24 does not rotate in this particular apparatus but has a diameter for convenient insertion within the usual central opening of a standard roll of tissue 26, which is normally provided with an inside cardboard cylinder 27, which can conveniently rotate on cylindrical support 24. By holding support 24 against rotation, the described construction provides a slight frictional resistance against undesired rotation of the tissue roll, after an end piece of the outer layer of tissue 25 has been pulled to the cutting edge for removal.

A lower tissue guide plate 28 is provided to facilitate separation of the outermost layer of tissue from the roll and to guide such layer to the cutting edge 14. This lower guide plate 28 has a movable inner end 29 which rests across the top of the tissue roll and gradually swings down toward the axis of bearing shafts 23 as the diameter of the tissue roll is decreased by removal of successive portions of the tissue strip.

The lower guide plate 28 has an outer edge with support portions 31 at each end of opening 13 for pivotally supporting the guide plate for swinging movement around a pivotal axis spaced inwardly from cutting edge 14 and providing a path for the tissue sheet between lower guide 28 and the cutting edge at the top of opening 13.

As shown in FIG. 3, the central portion of the pivoted edge of lower guide 28 is cut away at 32 to provide a substantial central area within which the fingers of a user, as inserted from the front through opening 13, can reach up and directly engage the free end of the tissue which is being supported on plate 28. (Also see FIG. 8).

The pivotal supports for the outer end support portions 31 of plate 28 are shown at 33. These supporting pins are carried by vertical flanges 34 which project inwardly and upwardly just beyond the ends of the cutting edge 14. As shown in FIG. 3, the guide plate 28 provides support at its inner edge 29 across substantially the entire width of the outermost layer of tissue. This lateral support is continued by the edge portions 31 of the plate close to the cutting edge, even though the central portion 32 is cut away for convenient direct contact of the user's fingers with the central portion of the strip.

According to a further feature of the invention, the body member has a liftable cover portion 36 which provides at least a top wall which can be moved upwardly away from the rest of the body member for convenient loading and threading of a suitable tissue roll. This cover portion also supports an upper paper guide or hold-down 37, which is preferably formed as a resiliently-flexible plastic strip having one end 38 fixed to the rear upper edge of the liftable cover portion 36, and with its other end extending toward the front opening 13 and overlapping and engaging the top surface of a layer of tissue carried by the pivoted lower guide 28.

As shown in FIG. 3, the free end 39 of upper guide 37 has a cut-out or open central area 39A corresponding generally to the open central area 32 of the lower guide plate 28. Thus the user's finger can engage the central area of the tissue strip 25 for convenient tissue withdrawal, e.g., as in FIG. 8.

To secure the fixed end of the upper hold-down, the underside of the cover is provided with a supporting block 40 which has a forwardly and downwardly sloping surface 41 on its underside. The downward angular inclination of surface 41 is designed to hold the guide 37 at a downward and forward angle which insures engagement of the vertically-flexible portion 39 of the upper guide member against the top surface of a layer of tissue carried by lower guide 28, even when the tissue roll is almost fully depleted so that the edge 29 of lower guide 28 is approaching close to the top of the cylindrical support 24. When the tissue roll is full, the flexible resilience of the upper guide or hold-down 37 permits it to swing upwardly and maintain its frictional engagement with the tissue layer on lower guide 28.

The light frictional engagement of the upper guide 37 with the top surface of the outermost tissue layer is designed to assist in preventing unintended rewinding of the end of the tissue strip back into the body member, after the end of the strip has been severed at cutting edge 14. For this purpose, the resiliently-movable end 39 of upper guide 37 should extend well across the top of the lower guide member 28 throughout the swinging movement of guide 28 from the top of a full roll of tissue to the point where the roll is empty. Thus the free end 39 of upper guide 37 should extend a substantial distance across the top of the roll toward the front wall, and at least to the cut out central portion 32 of the lower guide 28. As shown in FIGS. 2 and 3, this upper hold-down member 37 tapers outwardly and engages both the central and edge portions of a tissue on guide 28. It is held at the desired angle on surface 41 (FIG. 1) by having its fixed end 38 engaging the upper rear cover portion corner, which holds the end 38 from swinging downwardly, in combination with a downwardly projecting holding pin 43 on supporting block 40, and the engagement of the holding pin in a hole 44 in the end 38 of the guide 37. The hole 44 may be formed by cross slits in the hold-down strip, to provide a force fit with the pin 43.

In the preferred form of the invention, the body member 11 is constructed of two conveniently-moldable plastic parts and includes an open-topped base portion consisting of the bottom wall 17, and the lower portions of front wall 12, sidewalls 18 and 19 and rear wall 21. The top cover portion 36 then includes not only the top wall itself but also the necessary depending front wall portion 46, rear wall 47 and sidewalls 48 which are dimensioned to fit as vertical extensions of the open-topped base portion of the body member 11. These base and cover portions are separable along a separation line 49, which is designed to extend along the level at the top of bearing notches 22 and along cutting edge 14, so that the entire top portion of the body member can be conveniently removed for easy loading of the dispenser. Moreover, the cutting edge 14 is thus conveniently formed as part of the lower edge of the front wall 46 of the cover portion.

While it might be possible to provide for adequate separation of the cover portion from the base portion by hinging the bottom edge of the rear wall 47 at line of separation 49 to the top of rear wall 21 of the base portion, the embodiment shown in FIGS. 1 to 3 is designed for vertical removal and complete separation of the cover portion 36 from the base portion of the body 11.

As shown in FIGS. 2 and 3, the bearing plates or walls 51, in which the upwardly open bearing notches 22 are located, are provided as additional plates or thickened sidewall regions extending vertically from the separation line 49 to the bottom wall 17. These bearing plates or thickened walls project inwardly far enough to serve as limit stops for ends 52 at the inner edge 29 of the lower guide member, when both the tissue roll and the supporting cylinder 24 with its stub shafts 23 are removed for reloading. Thus the engagement of the lower guide 28 with such walls provides effective limit stops to prevent the guide plate from dropping all the way into the bottom of the base portion, prior to reloading. The swinging lower guide 28 is thus held at a more convenient level for manual engagement by the user to lift it all the way up and forwardly above front wall 12, when a new tissue roll is placed on the cylindrical support 24 and is to be inserted into the open-topped base portion with stub shafts 23 in bearing notches 22. Since the upper guide or hold-down 37 is carried by the relatively movable cover portion, it is necessarily moved out of the way of the loading operation when the cover portion is moved from its operating position covering the top opening to its separate open loading position.

To assist in positioning the cover in its operating position and to provide a smooth external sidewall surface for the assembled body member 11, as well as a suitable latching engagement, the outer surfaces of the cover portion sidewalls 48 are provided with vertical channels or recesses 53. Corresponding or matching vertical channels 54 are similarly provided in the base sidewalls 18 and 19 as extensions of the external recesses or channels 53 in the cover portion. A vertical latch member 56 having a width and thickness adapted to fit flush within the vertical channels 53 and 54 has its upper end riveted at 57 to the thinner wall portion 58 of cover sidewall 48 which serves as the inside of channels 53. Lower edge 51 of portion 58 does not extend all the way down to the separation line 49, but provides a limited space 62 between such lower edge 61 and the top of bearing plate 51 and stub shaft 23 at the separation line 49.

The lower ends of latch members 56 are provided with latch hooks 63 for locking engagement beneath corresponding shoulders in the portions of bearing plates 51 which overlap recess 54. A cam surface 64 on each latch member provides for automatic latching as each latch member engages the upper edge of bearing plates 51 at the top of channel 54 of the open top base, and then slides along the channel to locking position. The lower portions 66 of bearing walls 51 overlap and cover the inside of channels 54 and may be recessed externally to a slight additional extent as shown at 67 to insure convenient manual access to the end portions 64 of the latching hooks 63 for outward flexing of latch members 56, when the cover portions are to be removed.

To insure proper positioning of the removable cover portion, so that upper guide or hold-down member is extending in the proper direction, the vertical latch and channel members on the sidewalls of the respective base and cover members are positioned nearer to the rear walls 21 and 47 than to the front walls 12 and 46. Thus it is only possible to match the respective upper and lower body portions when the removable cover is properly oriented with respect to the open-topped base portion. Accurate positioning of the cover on the base is further insured by the location of the inner sidewall flanges 34 which support the pivot pins 33 for the lower guide plate 28. These flanges 34 are molded as integral portions extending upwardly from sidewalls 18 and 19 above separation line 49 to fit precisely within the front corners between front wall 46 and sidewalls 49 of the removable cover portion. Thus the assembled dispenser is insured as to proper alignment and proper strength at these front corner locations, where there is a possibility of application of undesired twisting or other forces as the user pulls out a desired length of tissue and tears it upwardly against the cutting edge 14.

As shown in FIG. 1, the inwardly and upwardly sloping ramp portion 16 from the bottom of opening 13 and front wall 12, extends to a peak at 68 which serves as the top of ramp 16. A rearwardly and downwardly sloping inner cross wall 69 is provided at the inside of ramp 16 and merges with a vertical inner wall 71 extending across the front of the base portion to provide an open-bottomed space 72 between the parallel wall portions 12 and 71. Such a construction facilitates the economic molding of such an open-topped base portion by a suitable plastic molding operation, in which the various recesses and walls of the element to be molded are generally accessible axially (in this case vertically) and require only linearly movable mold elements.

Reinforcing blocks 73 (FIGS. 1 and 2) may be adhesively connected within the front corners of cross recess 72 to provide a bottom supporting surface for rubber or other non-scratching supporting pads 74 at the front corners. Similar pads are provided at the rear corners beneath the flat bottom wall portions 17 at those corners.

The cover includes a smooth inner wall 75 which extends upwardly and rearwardly from the front wall 46 just above cutting edge 14 to the top wall 36. This inner wall may be a separate member adhesively joined at 75A and 75B to walls 36 and 46 as in FIG. 1 or it may be integrally molded as in FIG. 8. It provides a smooth inner surface against which the user's finger can engage the tissue to pull it through opening 13.

Figure 4:
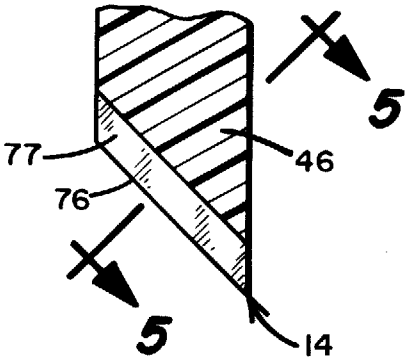
FIG. 4 is a partial sectional view of the cutting edge, taken along the line 4—4 of FIG. 2.
Figure 5:
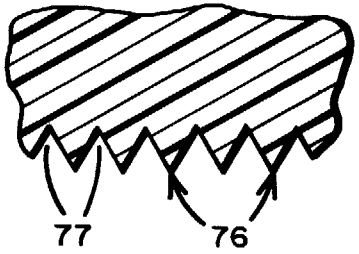
FIG. 5 is a partial sectional view of the cutting edge, taken along the line 5—5 of FIG. 4.

As shown in FIGS. 4 and 5, the described arrangement of parts makes it possible to provide the cutting edge 14 by means of suitably molded cutting teeth along the central portion of the bottom edge of cover front wall 46 which defines the upper edge of front access opening 13. As shown in FIG. 4, the bottom edge of wall 46 is forwardly and downwardly sloped toward the cutting edge 14, and this sloping surface has alternating V-shaped ridges 76 and notches 77 extending parallel to the direction of feed of the tissue strip. This construction provides cutting points at the edge 14 which can effectively sever the tissue strip, when its free end is lifted sharply up along the front wall 46, as indicated by the legend 15.

Figure 6:
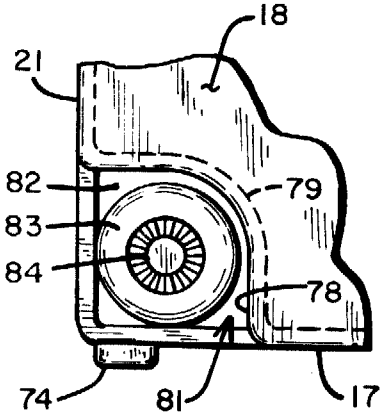
FIG. 6 is a partial view similar to FIG. 1, showing a modified construction providing an accessory storage recess at a lower rear corner of the dispenser.

FIG. 6 shows an alternate wall construction at a bottom rear corner of the lower base portion. Thus a suitable sidewall opening 78 is provided at the left bottom corner of a device similar to that of FIG. 1. An extra inner lateral wall 79 extends from bottom wall 17 to rear wall 21 and thus provides an open recess or chamber 81 between walls 17, 21 and 79. The inner end of chamber 81 may be closed by an inner end wall 82 parallel to and spaced inwardly from sidewall 18. The resulting recess is designed to receive, preferably in close-fitting frictional engagement, a small plastic container, such as a container 83 of eyeglass cleaning fluid. A threaded cap 84 on the end of such container can project outwardly from the recess in sidewall 18 and thus serve as a handle for pulling the container out of the recess when desired for use.

Figure 8:
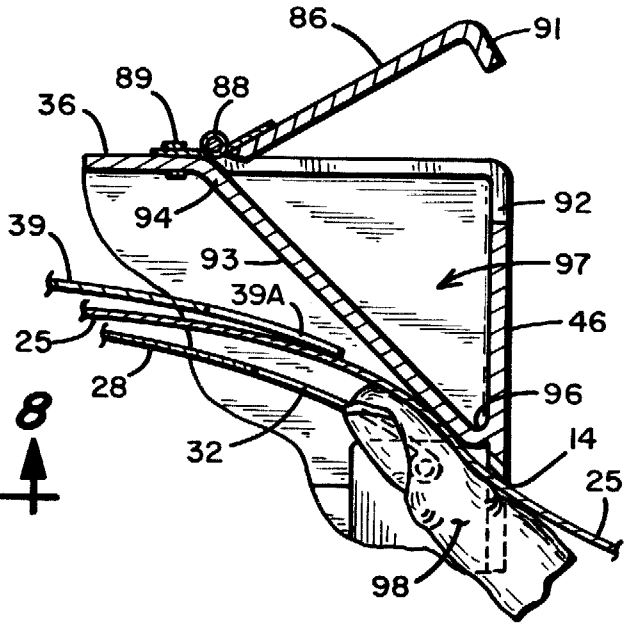
FIG. 8 is a partial sectional view on the line 8—8 of FIG. 7 showing further details of this modification.
Figure 7:
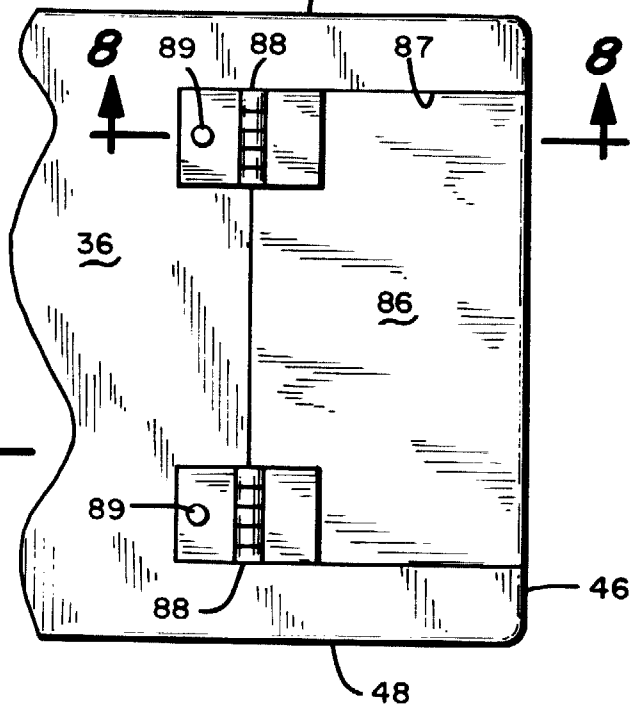
FIG. 7 is a partial top view showing a further modification to provide an accessory storage recess and auxiliary cover at the top front edge of such a dispenser.

FIGS. 7 and 8 show another possible modification in which a small storage recess can be provided at the upper front edge of a removable cover portion. In this case a cover 86 extends partway across the central portion of cover wall 36 to close a suitable opening 87 in the top wall. Cover 86 has hinges 88 secured at 89 to top wall 36. As shown in FIG. 8, the cover has a downwardly depending front lip 91 which fits a mating cutout across the central portion at the top of front wall 46. An inclined inner wall 93 extends across the upper front corner from 94 inside the hinge line in top wall 36 to portion 96 of the front wall 46 just above the cutting edge.

This modification accordingly provides a limited storage space 97, with its own auxiliary cover 86, which could be similarly used for a small container of eyeglass cleaner or for some other accessory.

The inner wall 93, like wall 75 in FIGS. 1 and 3, provides a smooth inner surface against which a user's finger 98 can press the tissue layer, at the central open areas 32 and 39A of the lower and upper guide members, to pull the tissue strip down past cutting edge 14 to cut off a desired and selectively variable length of tissue.

As shown in FIGS. 1 and 8, the underside of the inclined inner wall 75 or 93 can also serve as an upper limit stop for the free end 39 of upper hold-down guide 37. Thus the desired engagement of part of guide 37 against the top of a tissue layer on lower guide 28 can be facilitated when a full tissue roll is first inserted and might tend to flex upwardly the left portion of guide 37 closer to support 40 and thus bend the free end 39 upwardly against top wall 36 and out of contact with that part of the tissue layer which lies on top of guide 28.

The invention described herein accordingly provides an improved tissue dispenser which can be conveniently and economically constructed with molded plastic body and cover portions and which provides operating advantages in convenient withdrawal and cutting off of desired end portions from rolls of tissue material. The dispenser can operate with rolls of relatively light tissue material with efficient engagement of the user's fingers with the end of the strip to be severed and without undesired overrunning and feeding of undesired quantities of the tissue strip and without accidental retraction or loss of contact with the new free end of a tissue strip after an earlier portion of the strip has been severed. The relative arrangement of a pivoted, arcuate lower guide member on the open-topped base portion of such a device, and the provision of a resiliently-flexible upper guide or hold-down member on the separable cover portion of such a dispenser combine to provide a device which can be conveniently loaded and reloaded with minimal instruction and difficulty and which can be used effectively to provide desired lengths of toilet, facial or other tissue at any location to which the user desires to move such a portable device, and without the necessity of providing preperforated cross tear lines in a supply roll of tissue.

The foregoing specification sets forth certain preferred embodiments and modifications of the invention and some of the ways in which the invention may be put into practice. Modifications of the described embodiments, as well as alternate embodiments and devices for carrying out the invention, may also be apparent to those skilled in the art, within the spirit and scope of the following claims:

I claim:

1. Dispensing apparatus for tissue rolls of the type having a cylindrical axial central support opening, said apparatus comprising:

(a) a body member having
  (1) axially spaced tissue roll bearing portions, and
  (2) a cutting edge parallel to the axis of the bearing portions and spaced forwardly therefrom;

(b) a cylindrical roll support having
  (1) axially spaced end shafts for manually removable supporting engagement with said bearing portions, and
  (2) a cylindrical body portion adapted to slide coaxially into such a tissue roll support opening;

(c) a lower tissue guide plate having (1) an outer edge pivotally supported on the body member for swinging movement around an axis parallel to and spaced inwardly close to the cutting edge, (2) an inner guide edge above and parallel to the roll support, and (3) an intermediate plate portion extending between the pivotally supported outer edge and said inner guide edge and substantially across the full width of the tissue to be withdrawn tangentially from such a roll mounted on the roll support;

the inner edge of the guide plate being adapted to rest on top of the tissue roll beneath the uppermost layer of tissue and thereby support such layer for movement from the top of the roll and past said cutting edge; and (d) a resiliently flexible upper guide and hold-down member extending in frictional engagement along the upper surface of a tissue layer supported on the lower guide plate between the tissue roll and cutting edge and thereby preventing unintended rewinding and withdrawal of the free end of the outermost tissue layer, after an end portion thereof is severed at the cutting edge.

2. Dispensing apparatus according to claim 1 in which the body member includes an upwardly open base portion with front, rear and side walls, and a top opening, and a cover portion relatively movable between an operating position covering the top opening and an open loading position for loading a tissue roll downwardly through the top opening, said bearing portions being mounted on the base portion side walls, said front wall having a transverse feed opening through which the tissue from the outermost layer of such a roll can extend across the cutting edge for cutting and removal, the base portion also having guide plate bearing supports for the pivotally supported outer edge of the lower tissue guide plate, said guide plate bearing supports being positioned for upward pivotal swinging movement of the lower guide plate inner edge when the cover portion is in open position and thereby facilitating insertion of a tissue roll, swinging of the guide plate inner edge down to the top of the roll and initial threading of the outermost end of the tissue across the top of the guide plate and out through the front wall opening.

3. Dispensing apparatus according to claim 2 in which the base portion and lower guide plate have cooperating limit stops preventing the inner guide plate edge from dropping to the bottom wall when the cover portion is in its open loading position and the cylindrical roll support is removed for loading a fresh tissue roll thereon.

4. Dispensing apparatus according to claim 2 in which the upper guide and hold-down member is supported on the cover member for automatic engagement with tissue on the lower guide plate when the cover is moved to operating position.

5. Dispensing apparatus according to claim 4 in which the upper guide and hold-down member has a fixed end secured to the cover member at a location close to the plane of said rear base portion wall and a vertically movable end extending forwardly above the lower guide plate at a vertical angle providing resilient frictional engagement of said hold-down with the tissue on the lower guide plate throughout gradual downward swinging movement of the guide plate as the removal of tissue decreases the diameter of the tissue roll.

6. Dispensing apparatus according to claim 4 in which the cutting edge has downwardly projecting teeth and extends across the top of the transverse feed opening in the front wall.

7. Dispensing apparatus according to claim 6 in which the relatively movable cover portion has a top wall with front, rear and side wall portions depending therefrom for matching engagement along upper edges of the corresponding front, rear and side walls of the base portion when the cover portion is in operating position, said cover portion front wall and base portion front wall having a line of separation along the top of the transverse feed opening with the cutting edge teeth located on the lower edge of the cover portion front wall and defining the top of the feed opening.

8. Dispensing apparatus according to claim 7 in which the base portion front wall has an upwardly and rearwardly inclined transverse ramp defining the bottom of the transverse feed opening at a distance below the cutting edge which permits insertion of a user's fingers to help grasp and pull a free end portion of tissue for separation at the cutting edge.

9. Dispensing apparatus according to claim 8 in which the pivotally supported outer edge of the lower guide plate has a pivotally supported portion at each transverse end thereof and an opening in the central area of said outer edge between the pivotally supported portions for engagement of a user's finger with a corresponding central area of a tissue portion supported on the guide plate.

10. Dispensing apparatus according to claim 9 in which the cover portion has a smooth inner wall inclined upwardly and rearwardly from the cutting edge above the opening in the central area of the outer edge of the lower guide plate to facilitate engagement of the user's finger to press the corresponding central area of a tissue portion against the smooth inner wall and draw the tissue out through the front wall opening.

11. Dispensing apparatus according to claim 10 in which the vertically-movable end of the upper guide and hold-down member has its vertically-movable end provided with an open area corresponding generally with the opening in the central area of the outer edge of the lower guide plate.

12. Dispensing apparatus according to claim 7 in which the base and cover portions are designed for relative movement of the cover portion from operating position to loading position along a vertical path perpendicular to the base portion bottom wall, the opposite side walls of the base and cover portions having outer surfaces with respective aligned vertical channels therein, respective resiliently movable latch members each having one end filling and secured within the respective vertical channels of one of the base and cover portions and each having a laterally movable latch hook at its other end extending within the respective vertical channels of the other one of the base and cover portions, and a latching shoulder extending across each of said last-mentioned vertical channels for locking engagement by the respective latch hooks to hold the cover portion in assembled position.

13. Dispensing apparatus according to claim 12 in which the lower guide plate bearing supports are fixed at the front corners of the base portion and project upwardly above the separation line for positioning engagement within the front and side walls of the cover portion just above the separation line at each front corner of the cover portion.

14. Dispensing apparatus according to claim 12 in which said base and cover portions are made of molded plastic material and are formed with generally vertical wall portions, vertically accessible recesses and single transverse bottom and top wall portions for economical separate molding of each respective base portion and cover portion between relatively movable upper and lower mold members which can move linearly with respect to each other along a common axis perpendicular to the transverse bottom and top wall portions.

15. Dispensing apparatus according to claim 7 having a transversely extending accessory storage recess in one of the base and cover portions of the body member.

16. Dispensing apparatus according to claim 15 in which the storage recess is positioned at one rear lower corner of the body member, extends along the intersection of the bottom and rear walls thereof and has an access opening in the lower rear corner of the sidewall thereof.

17. Dispensing apparatus according to claim 15 in which the storage recess is positioned inside the upper front and top walls of the cover portion and includes an auxiliary inner transverse wall extending upwardly and rearwardly from a line just above the cutting edge on the cover portion front wall to the cover portion top wall, a portion of the cover portion front and top walls above said auxiliary inner transverse wall having a manually movable hinged cover providing access to said storage recess.

* * * * *